United States Patent [19]

Kochan, Jr.

[11] Patent Number: 5,071,370

[45] Date of Patent: Dec. 10, 1991

[54] CONNECTOR SYSTEM FOR USE WITH ELECTRICALLY OPERABLE PUMPS

[75] Inventor: John R. Kochan, Jr., Naperville, Ill.

[73] Assignee: Metropolitan Pump Company, Romeoville, Ill.

[21] Appl. No.: 621,802

[22] Filed: Dec. 4, 1990

[51] Int. Cl.[5] ..... H01R 13/00

[52] U.S. Cl. ..... 439/620; 439/651

[58] Field of Search ..... 439/620, 577, 650, 651, 439/652

*Primary Examiner*—Joseph H. McGlynn

*Attorney, Agent, or Firm*—Dressler, Goldsmith, Shore, Sutker & Milnamow, Ltd.

[57] ABSTRACT

A two part electrical connector system is provided for easily connecting the plug of an electrical device having two or more independently operable switches to a source of electrical energy. Each of the switches terminates in a two-part electrical connector formed as a plug and a receptacle. The members of the connector system can be coupled to the plug and receptacle portions of the switch terminating electrical connectors respectively. The interconnected assembly can be coupled to the source of electrical energy. The electrical plug of the associated device can then be engaged with the connector system. As one or the other of the independently operable switches responds to a predetermined condition electrical energy is coupled from the source, via the connector system and the responding switch, to the device energizing same.

12 Claims, 2 Drawing Sheets

CONNECTOR SYSTEM FOR USE WITH ELECTRICALLY OPERABLE PUMPS

FIELD OF THE INVENTION

The invention pertains to a method and connector system for coupling an electrical device having a plurality of actuation switches to a source of electrical energy. More particularly, the invention pertains to a two-part electrical connector system usable to couple an electrically powered device, via first and second independently actuatable switches, to a source of energy.

BACKGROUND OF THE INVENTION

Submersible pumps are known for use in basement sump as well as septic tank effluent and sewage applications. Such pumps are generally electrically operated with electrical energy being controlled by means of an on/off switch sensitive to fluid level. For example, float type switches change orientation as the fluid level increases thereby causing the switch to close applying electrical energy to the pump which in turn pumps down the fluid level. Alternately, pressure actuated switches are known which function similarly.

Pumps in many applications are conventionally powered from a standard ac utility type receptacle. For ease of connecting to the source, the float or pressure switches are conventionally provided with electrical cables that terminate in a two-part electrical connector sometimes referred to as a "piggyback" switch connector.

Such connectors have a standard ac plug and also carry adjacent thereto a standard ac receptacle. If the float or pressure switch is a single pole switch, one element of the electrical plug is coupled by the switch to a corresponding element of the electrical socket. Hence, if the two-part connector is then plugged into the source of electrical energy and the pump is in turn plugged into the receptacle of the two-part connector, the pump can be switched on and off through the float or pressure switch without the need for any separate wiring.

While such pumps are particularly useful and convenient, the switches associated therewith are subject from time to time to failure. Hence, it would be desirable to be able to couple a plurality of independently actuated switches between the source of electrical energy and the pump in order to provide redundancy or backup in the event of a single switch failure. It would further be desirable to be able to make this electrical connection without the need for any special wiring or modification to the electrical plug of the pump. At all times, it is particularly desirable to be able to, for backup purposes, couple the plug for the pump directly to the source of electrical energy to be able to continuously run the pump in the event of an emergency.

SUMMARY OF THE INVENTION

A connector system which is usable to interconnect an electrical device, such as an electric pump, to a source of electrical energy provides for ease for connection between the source of energy and two or more switches. Each of the switches is independently responsive to a predetermined condition and, when in a closed or responsive state, couples electrical energy from the source to the electrical device.

The system includes a first electrical connector member which has a coupling element for coupling to the source. The first electrical connector member also includes at least two switch input ports for coupling two switches.

The system further includes a second electrical connector having at least first and second parallel switch output ports. The switch output ports are usable for coupling to each switch The second electrical connector further includes an electrical device coupling port. The electrical device coupling port is connected to the switch output coupling ports. The electrical device can be connected to the coupling port.

The connector system can be used with the electrical device for coupling the device to the source of electrical energy through the independently operable switches. Alternately, the electrical device can be directly coupled to the source of electrical energy for continuous operation.

The element for coupling to the electrical source can be formed as an electrical plug. This electrical plug can be formed with substantially the same shape and dimensions as an electrical plug carried by the electrical device.

In addition, each of the switch input ports can include an electrical socket. These sockets are connected in parallel.

The switch output ports can each include an electrical plug with the plugs connected in parallel. If each of the switches terminates in a two part electrical connector having both a plug and a socket, the two part electrical connectors can be positioned between the first and second electrical connector members and the assembly can then be coupled to the source of electrical energy. Finally, the electrical device can be coupled to the second connector member via the device coupling port.

In the event that the electrical device in turn terminates in a plug, the device coupling port can be formed as a plug receiving socket.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
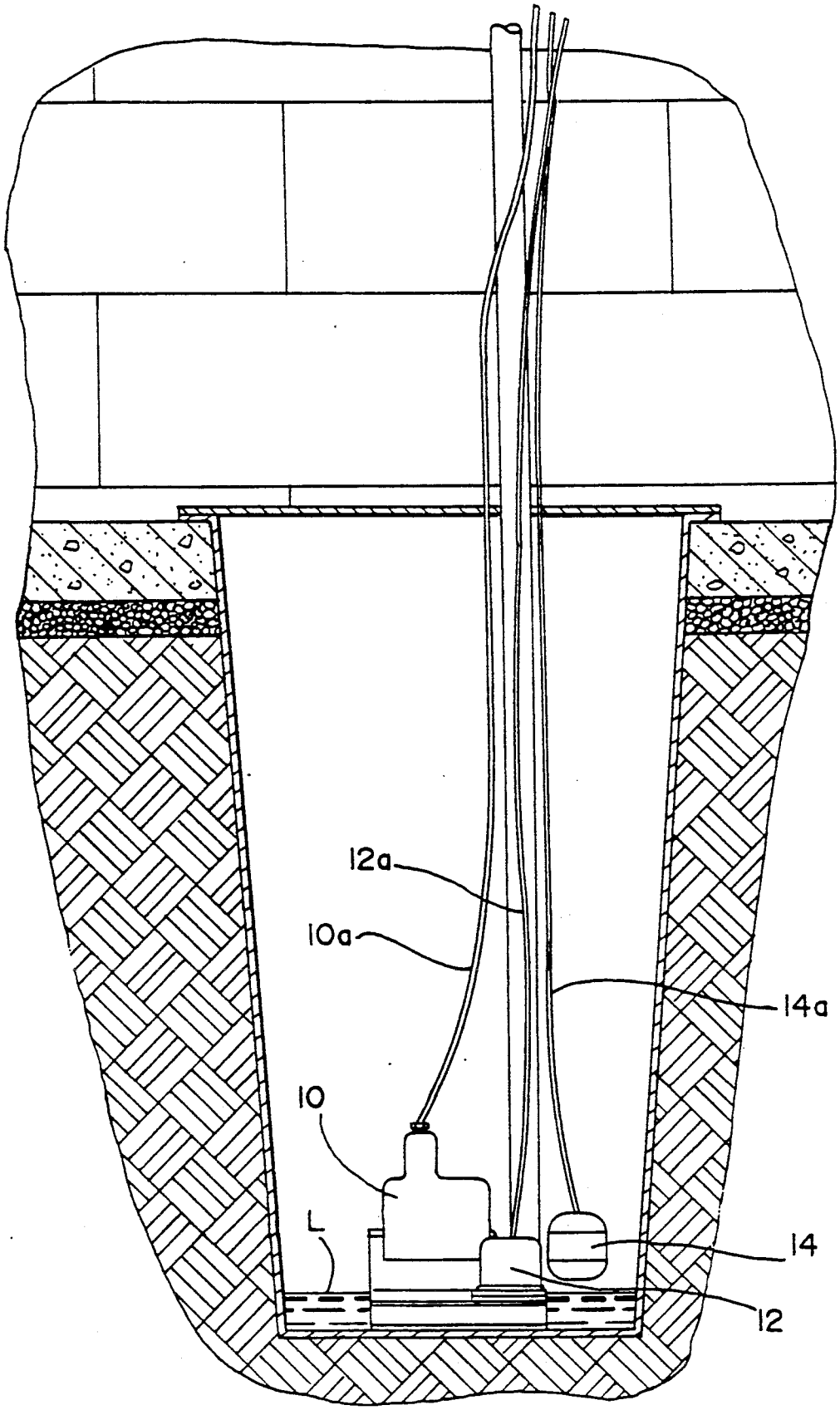
FIG. 1 is a sectional view of a sump in which is located and illustrated in a side elevational view, a pump and first and second electrical switches coupled to a source in accordance with the present invention.

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

FIG. 1 illustrates an electrical pump 10 in a sump or fluid collection site which can be energized with first and second independently operable electrical switches 12 and 14.

The switches 12 and 14 in the disclosed embodiment are each submersible switches responsive to a level of fluid L in the sump adjacent the pump 10. The switch 12 is a diaphragm switch which is carried on the housing for the pump 10 and is responsive to pressure generated by the fluid level L. The switch 14 is a float type switch which changes position in response to the level of the fluid L.

The pump 10 along with the switches 12 and 14 are coupled to a connector system 20 by means of respective electrical cables 10*a*, 12*a*, and 14*a*. The connector system 20 in combination with the pump 10 as well as the switches 12 and 14 can be used to couple electrical energy from a source, illustrated in FIG. 1 by a standard ac receptacle 22, to the pump 10.

The pump cable 10*a* terminates in an electrical plug 10*b*. The switch cables 12*a*, 14*a* each terminate in a "piggyback" type connector 12*b* and 14*b*.

It will be understood that while an electrically operated pump 10 is illustrated in FIG. 1 the present invention can be utilized with other types of electrical devices. The particular type of electrical device used with the connector system 20 is not a limitation of the present invention. Similarly, alternative types of switches other than fluid level responses switches, such as the switch 12 and 14, can be used with the connector system 20. The nature and characteristics of the switches used are not a limitation of the present invention.

Figure 2:
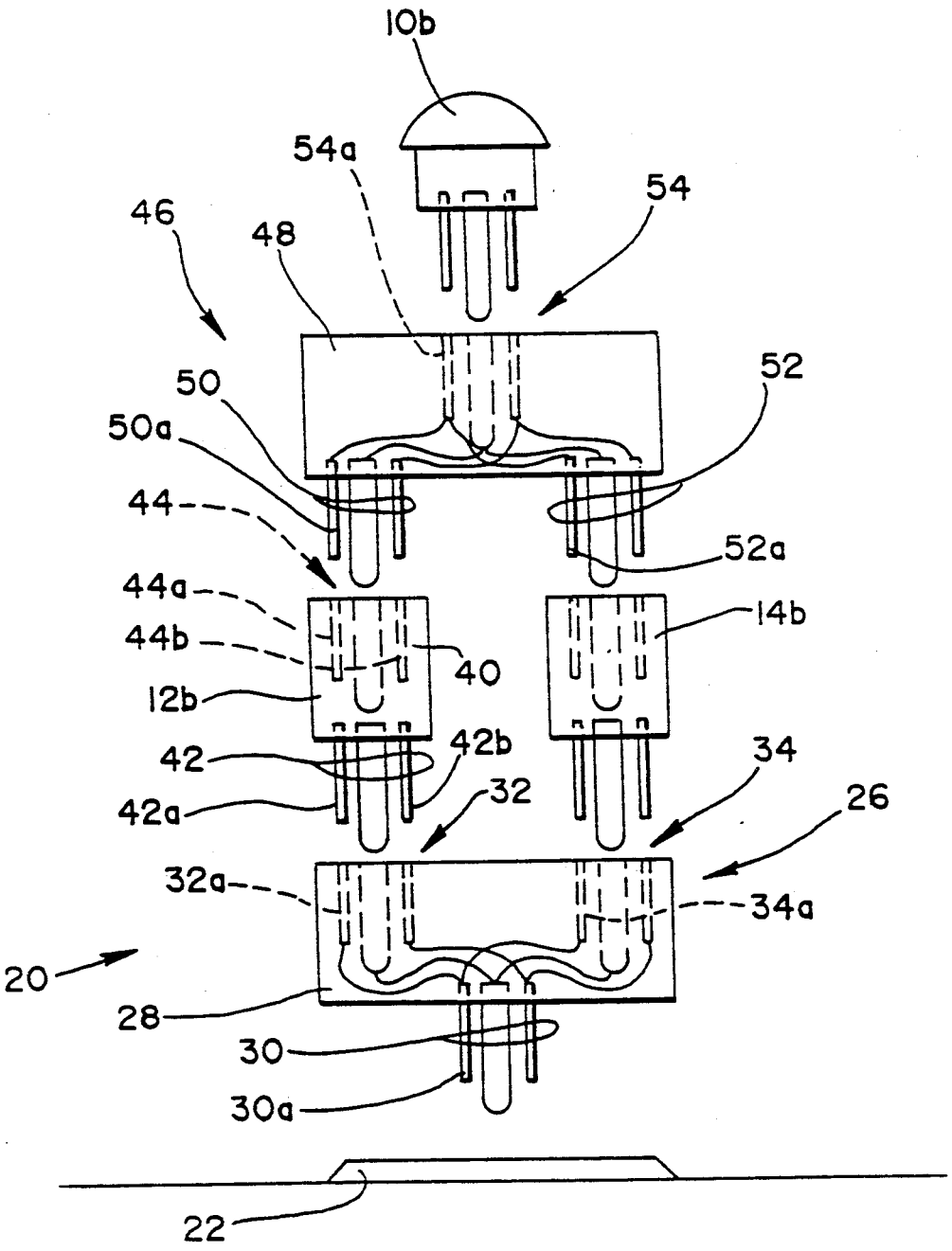
FIG. 2 is an exploded plan view of a connector system in accordance with the present invention illustrating the electrical and mechanical interrelationships of various elements thereof.

The structure of the connector system 20 is illustrated in detail in FIG. 2. The system 20 includes a first connector member 26 formed with an elongated insulative body portion 28. The connector member 26 includes a standard three prong ac plug 30 for coupling to the electrical receptacle 22.

The connector member 26 also carries on the body 28 first and second receptacles 32 and 34. Each of the receptacles 32 and 34 is a standard three prong ac receptacle. Each of the elements of the receptacle 32 such as element 32*a* is coupled to a respective element, such as element 30*a* of the plug 30. Similarly, each of the elements of the socket 34, such as the element 34*a*, is also coupled to a respective member of the plug 30 such as the element 30*a*. Hence, socket 32 is electrically coupled in parallel with socket 34.

Each of the sockets of 32 and 34 can slidably receive a plug of a respective one of the two-part connectors 12*b* or 14*b*. The two-part connector 12*b* is the same as the connector 14*b* and a description of one also describes the other.

The connector 12*b* includes a body portion 40. Extending from the body portion 40 is a three element electrical plug 42. Formed in the body portion 40 is a three element electrical socket 44.

The switch 12 is coupled between at least one pair of elements, such as prong 42*a* and socket member 44*a*. The remaining elements, such as plug element 42*b* can be directly connected to respective socket element 44*b*.

Alternately, if switch 12 is a double pole switch the prong 42*b* can be coupled to the socket member 44*b* via the second pole on the switch 12. Similar electrical connections apply for the two part electrical connector 14*b*.

The connector system 20 also includes a second electrical connector member 46 which has an elongated insulative body portion 48. The body portion 48 carries first and second three element electrical plugs 50 and 52. The body 48 also includes a three element electrical socket 54. The respective elements of the plugs 50 and 52 are electrically coupled in parallel to respective elements of the socket 54. Hence, plug element 50*a* is electrically coupled to plug element 52*a* and corresponding socket element 54*a*.

The cable 10*a* for the pump 10 terminates in the three prong electrical plug 10*b* as illustrated in FIG. 2. The plug 10*b* if desired can be directly coupled to the socket 22 to constantly energize the pump from the source of ac energy. Alternately, the plug 10*b* can be coupled to the outlet 22 by means of the electrical connector system 20 and the two part electrical connectors 2*b* and 14*b*.

In this latter arrangement the first connector member 26 is coupled to the electrical outlet 22 by means of the plug 30. The two-part electrical connectors 12*b* and 14*b* are in turn coupled to the receptacles 32 and 34 of the connector element 26.

The second electrical connector member 46 is in turn coupled to the receptacles, such as receptacle 44, of the two-part connectors 12*b* and 14*b* by means of plugs 50 and 52. Finally, the electrical plug 10*b* for the pump 10 is coupled to the second electrical connector using the receptacle 54.

The resulting combination enables the pump 10 to be operated independently via switch 12 or 14 without any special wiring. Alternately, the pump 10 can be operated continuously off of the electrical outlet 22 merely by removing the system 20 and coupling the plug 10*b* to the receptacle 22.

While the present invention has been described by means of a particular electrical device, an electrical fluid or sump pump, in combination with two independently actuatable on/off switches it will be understood that other types of electrical devices can be used with the present invention. Further, other types of independently actuatable on/off switches may be used with the present invention without departing from the spirit and scope thereof.

Finally, it will be understood that the type of electrical energy source utilized to power the electrical device is not a limitation of the present invention. Instead of a conventional ac receptacle or source, a different receptacle or a dc source of some type could be used.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

We claim:

1. A connector system usable to interconnect an electrical device with two or more switches to a source of electrical energy, each switch is independently responsive to a predetermined condition, the system comprising:

a first electrical connector member having a coupling element for coupling to the source, and at least two switch input coupling ports for coupling to each of the switches;

a second electrical connector member having at least first and second parallel switch output coupling ports for coupling to each switch and an electrical device coupling port connected thereto for coupling to the device.

2. A system as in claim 1 with said switch input ports connected in parallel.

3. A system as in claim 1 with said source coupling element including an electrical plug.

4. A system as in claim 1 with each of said switch input ports including an electrical socket with said sockets connected in parallel.

5. A system as in claim 1 with each of the switches terminating in a switch electrical connector having both a plug and a socket with respective elements of the plug and the socket electrically connected to the switch and with said switch input ports of said first member and said switch output ports of said second member interconnected by the respective switch electrical connectors when said first and second connectors are coupled thereto.

6. A system as in claim 1 with said parallel switch output ports each including an electrical plug with said plugs connected in parallel.

7. A system as in claim 6 with said device coupling port including an electrical socket, with said socket including first and second electrical conductors and with each said conductor connected to each of said electrical plugs of said switch output ports.

8. A modular pump system, operable by a source of electrical energy, the system comprising:

an electric pump having at least two on-off switches associated therewith with each said switch responsive to a predetermined condition, said pump terminating in a pump electrical connector engageable with the source and with each said switch terminating in a two-part switch connector having a plug and a receptacle;

first and second electrical connector members, said first electrical connector member having a coupling element engageable with the source, and at least two switch input coupling ports for coupling to a first part of each of said switch connectors;

said second electrical connector having at least first and second parallel switch output coupling ports for coupling to a second part of each of said switch connectors and an electrical pump coupling port connected thereto for coupling to said pump electrical connector.

9. A system as in claim 8 with said pump electrical connector and said coupling element of said first electrical connector member each including an electrical plug for engaging the source.

10. A two part connector system for use with a dual switch fluid level activatable electric pump, the pump having an electrical plug, and each switch having an electrical connector with an input and an output port, the connector system comprising:

a first connector having an electrical plug and two parallel input sockets with each of the switch input ports couplable to a respective one of the input sockets, and a second connector having two parallel output plugs and an input socket with each said output plug couplable to a respective one of the switch output ports and with said input socket couplable to the pump electrical plug.

11. A connector system as in claim 10 with the pump electrical plug and said first connector electrical plug each including first and second substantially identical electrical prongs.

12. A connector system for use with a pump that is operable from a source of electrical energy, energy being selectively provided to the pump by means of two or more switches responsive to a selected condition, the system comprising:

a first connector having one output port and two or more parallel, input ports with said output port couplable to the source of energy and with each of the input ports couplable to a respective one of the switches;

a second connector having two or more parallel output ports and one input port with each of said output ports of said second connector couplable to a respective one of the switches and said input port thereof couplable to the pump with the pump alternately directly engageable with the source, instead of with said second connector input port.

* * * * *

UNITED STATES PATENT AND TRADEMARK OFFICE

CERTIFICATE OF CORRECTION

PATENT NO. : 5,071,370

DATED : December 10, 1991

INVENTOR(S) : John Redmond Kochan, Jr.

It is certified that error appears in the above-identified patent and that said Letters Patent is hereby corrected as shown below:

Col. 4, line 13, "2b" should be --12b--.

Signed and Sealed this

Sixteenth Day of March, 1993

*Attest:*

STEPHEN G. KUNIN

*Attesting Officer*

*Acting Commissioner of Patents and Trademarks*